United States Patent [19]

Kowalski

[11] Patent Number: 4,660,817

[45] Date of Patent: Apr. 28, 1987

[54] MULTI-STEP CONTROL APPARATUS FOR PATIENT TREATMENT TABLE

[75] Inventor: Frank P. Kowalski, Des Plaines, Ill.

[73] Assignee: Standex International, Salem, N.H.

[21] Appl. No.: 714,486

[22] Filed: Mar. 21, 1985

[51] Int. Cl.[4] ..... A61G 13/00

[52] U.S. Cl. ..... 269/323; 128/69; 108/7; 108/20

[58] Field of Search ..... 269/323, 324, 325, 328; 254/110; 128/68, 70, 73; 108/1, 7, 20

[56] References Cited

U.S. PATENT DOCUMENTS

| | | | |
|---|---|---|---|
| 3,473,024 | 10/1969 | Feiertag | 269/323 |
| 4,168,099 | 9/1979 | Jacobs et al. | 269/325 |
| 4,183,502 | 1/1980 | Skaalen | 254/110 |
| 4,195,829 | 4/1980 | Reser | 269/325 |
| 4,401,110 | 8/1983 | Ekholm | 128/70 |

*Primary Examiner*—Frederick R. Schmidt

*Assistant Examiner*—Judy J. Hartman

*Attorney, Agent, or Firm*—Mason, Kolehmainen, Rathburn & Wyss

[57] ABSTRACT

A multi-step control apparatus is provided for raising and lowering a patient treatment table in response to predetermined successive motions of the foot of an operator. An operating rod mounted transversely of the table has a foot pedal on each end thereof and is biased to a mid position both longitudinally and rotationally. In response to inward pressure on either foot pedal a timing cycle is initiated during which the doctor may then initiate a raising or lowering cycle for the table by stepping on one side or the other of the foot pedal and rotating the operating rod out of a neutral rotational position. However, a raising or lowering cycle cannot be initiated without first moving the operating rod inwardly to initiate the timing cycle so that accidental or inadvertent raising or lowering of the table by simply rotating the foot pedal is prevented.

13 Claims, 7 Drawing Figures

FIG. 2
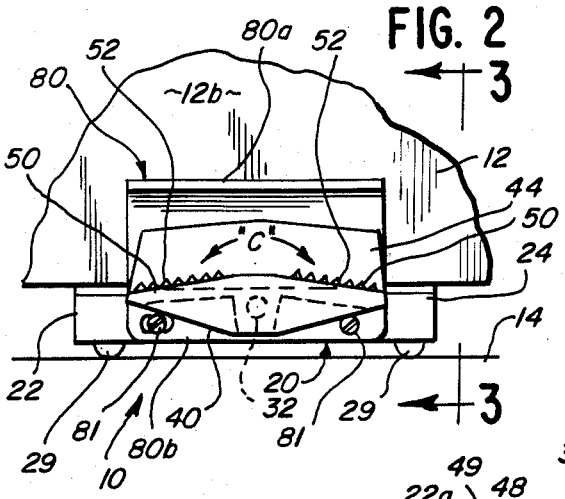
FIG. 3
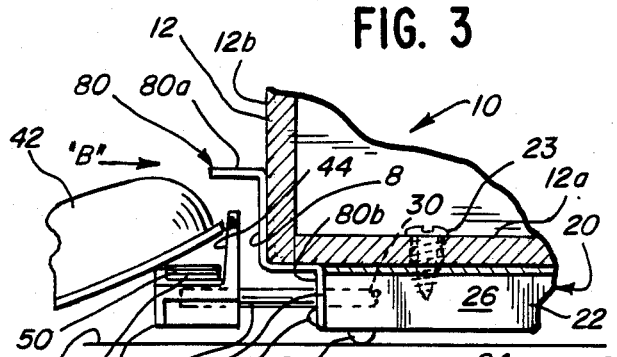
FIG. 4
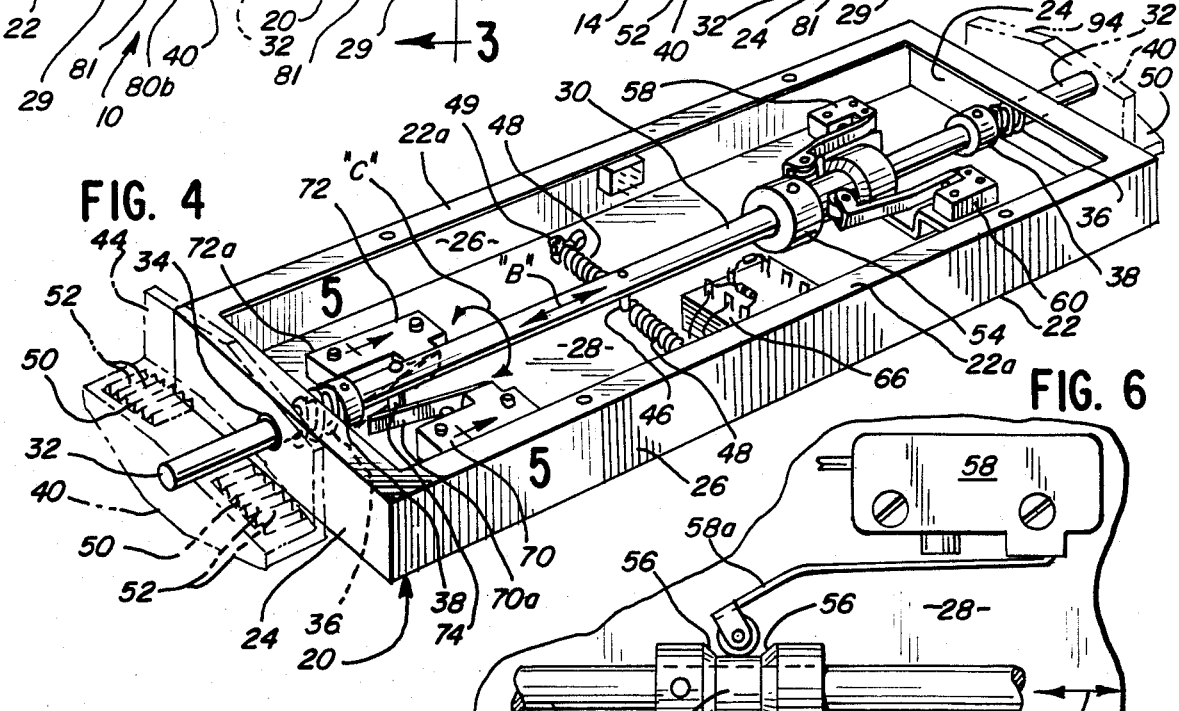
FIG. 6
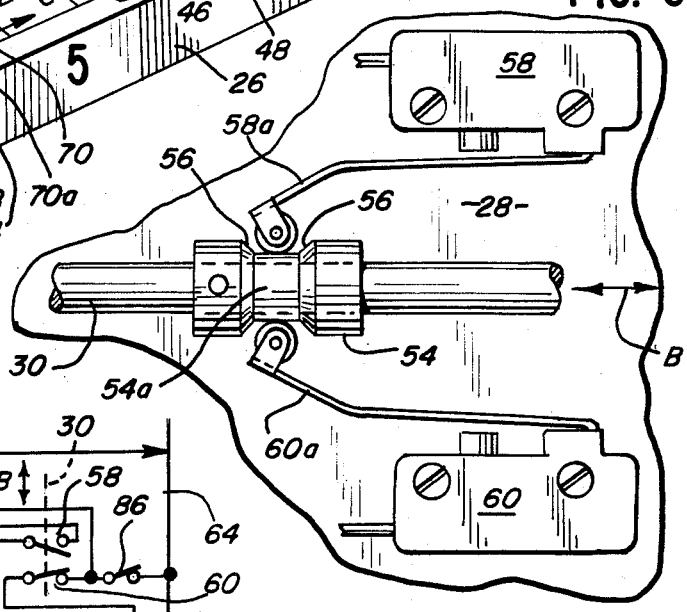
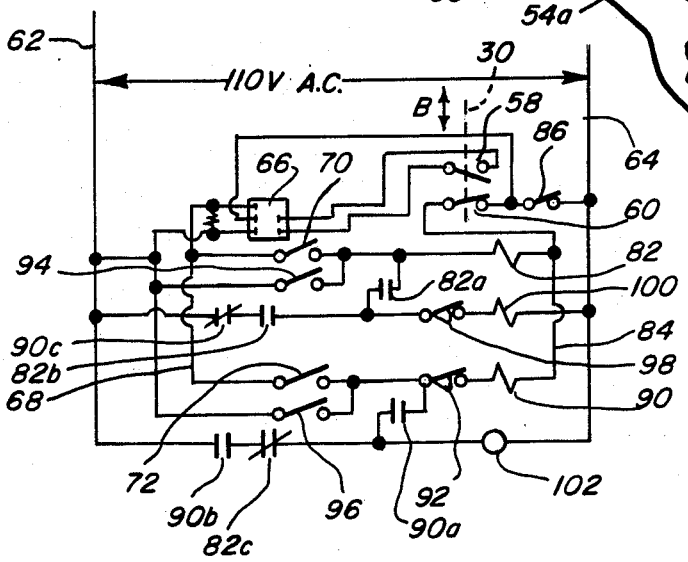
FIG. 7
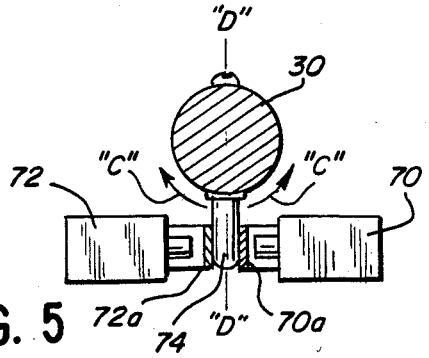
FIG. 5

MULTI-STEP CONTROL APPARATUS FOR PATIENT TREATMENT TABLE

BACKGROUND OF THE INVENTION

1. Field of the Invention

The present invention relates to patient treatment tables, such as chiropractic tables, and, more particularly, to a new and improved multi-step control apparatus for controlling the lowering and raising of a patient treatment table in a careful, safe and selective manner.

2. Description of the Prior Art

A number of chiropractic patient treatment tables have been developed over the years, such as the table shown in U.S. Pat. No. 4,401,110, in which raising and lowering of the table between a generally horizontal and a near vertical position, to facilitate a patient in mounting and dismounting, has been controlled by foot switches operated by the doctor during the course of his treatment. While these arrangements have in general been satisfactory for their intended purpose, they suffer the disadvantage that they may be accidentally or inadvertently actuated, for example, by a child playing on the floor near an unattended table. Such a situation is quite undesirable, particularly when the table is in a raised position, due to the possibility that someone could be injured by either the weight of the lowering table or pinched between the table and its base near the foot end of the table where it is pivotally mounted on a base structure.

It is an object of the present invention to provide a new and improved multi-step control apparatus for a patient treatment table.

More particularly it is an object of the invention to provide a multi-step control apparatus which is efficient, precise and safe in operation and which provides precision control for the raising and lowering of a patient supporting table of a patient treatment apparatus.

Another object of the present invention is to provide a new and improved multi-step control apparatus adapted to be operated from either side of a patient treatment table by a doctor's foot.

Yet another object of the present invention is to provide a new and improved multi-step control apparatus which requires a multi-step control process in order to actuate a patient support table to raise, lower or stop in mid-travel thus reducing the chances of an inadvertent or accidental operation of the table.

Another object of the present invention is to provide a multi-phase control system designed to eliminate the chances of accidental or inadvertent unwanted movement of a patient treatment table controlled thereby.

Still another object of the present invention is to provide a multi-step control apparatus of the character described having means operable during a second phase of operation in raising or lowering the table so that the process can be stopped immediately by foot pressure.

More specifically, it is an object of the present invention to provide a multi-step control apparatus for a patient treatment table which requires inward foot pressure on the control apparatus to initiate a first step in the control process followed by rotational pressure on a foot pedal in the selected direction to effect a raising or lowering of the table.

Still another object of the present invention is to provide a new and improved patient treatment table having a multi-step foot control apparatus of the character herein described in combination with manually controllable switches at convenient locations on an upper portion of the table resulting in a safe and easily controlled table operation while ensuring a safe and precision control capability.

BRIEF SUMMARY OF THE INVENTION

The foregoing and other objects and advantages of the present invention are accomplished in a new and improved, multi-phase or multi-step control apparatus for a patient treatment table including an operator mounted for longitudinal reciprocal movement and supported for rotational movement about an axis. A contact member such as a foot pedal is mounted on the operator and is adapted to be actuated by direct contact from a doctor's foot to move the operator longitudinally as a first step to initiate a timing cycle operation and thereafter to rotate the operator in a selected direction about the axis as a second phase or step in the sequence to raise and lower a patient treatment table. A first stop/reset switch is activated by the first step for energizing a timer and the timer in turn energizes a control circuit for a selected period of time after the switch is activated. The circuit includes at least one secondary switch activated by rotational movement of the operator in a second phase of operational control and this provides a control capability for an electrical element used in controlling the raising or lowering of a patient treatment table. Because a dual or multi-step control function is required, the chances of inadvertent or accidental operation of the table and/or control apparatus are minimized. In addition, manual control switches are provided in the circuit and are positioned conveniently on an upper portion of the patient table for hand control by a doctor to raise, lower and tilt the patient supporting portion of the table (without timer activation).

BRIEF DESCRIPTION OF THE DRAWINGS

For better understanding of the present invention, reference should be had to the following description taken in conjunction with the drawings, in which:

FIG. 2 is a fragmentary, side elevational view of the patient treatment table illustrating in enlarged detail, a multi-step control apparatus thereof in accordance with the features of the present invention;

FIG. 3 is a fragmentary, transverse cross-sectional view taken substantially along lines 3—3 of FIG. 2;

FIG. 4 is a perspective view looking downwardly on the multi-step control apparatus shown as separate and apart from the patient treatment table; FIG. 5 is a fragmentary cross-sectional view taken substantially along lines 5—5 of FIG. 4;

FIG. 6 is an enlarged, fragmentary top elevational view looking downwardly at a right hand end portion of the control apparatus as illustrated in FIG. 4; and FIG. 7 is a schematic diagram of an electrical control circuit of the apparatus and patent treatment table.

DETAILED DESCRIPTION OF A PREFERRED EMBODIMENT

Figure 1:
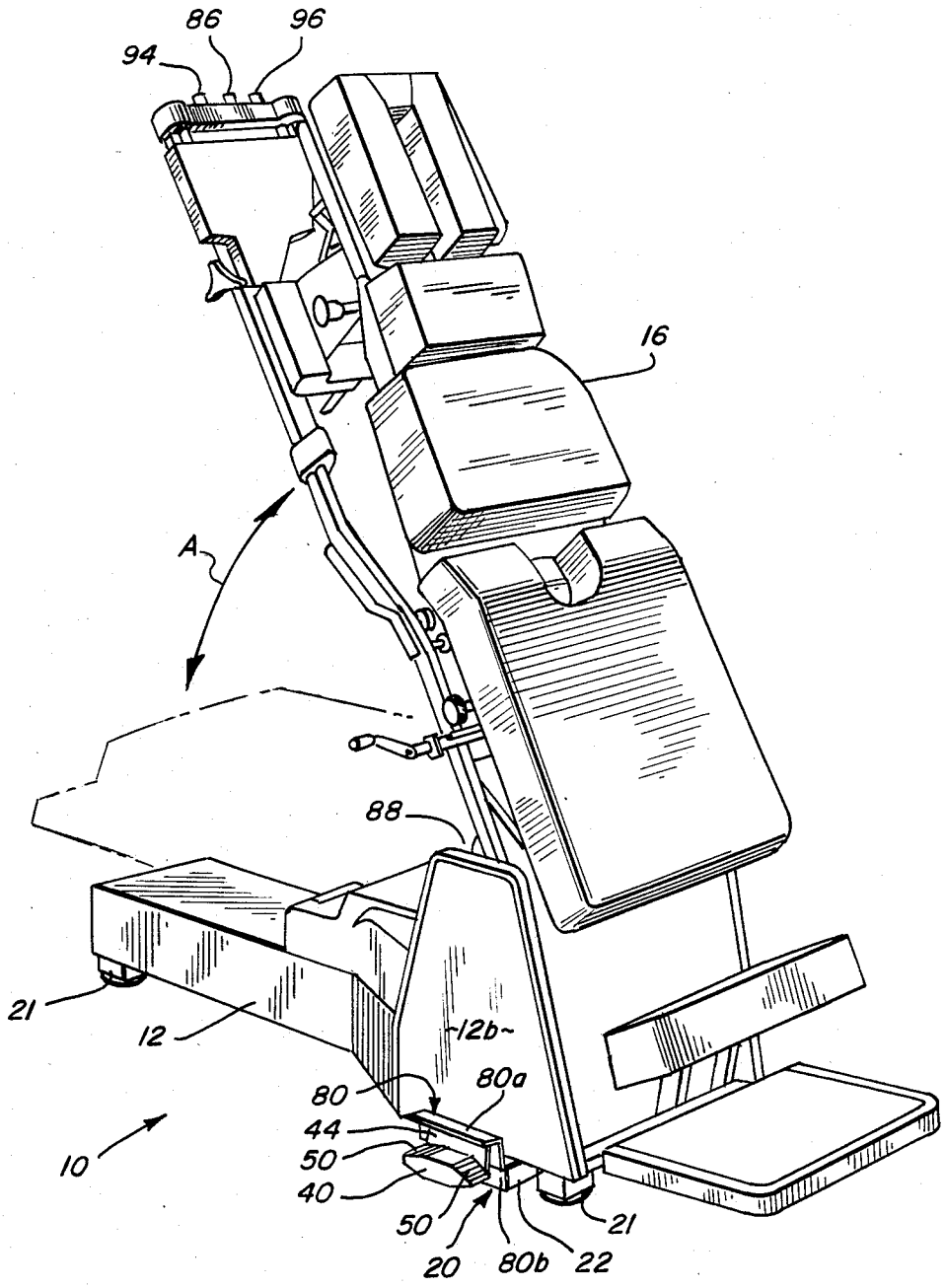
FIG. 1 is a front elevational view of a new and improved patient treatment table constructed in accordance with the features of the present invention and shown in solid lines in an upstanding, near vertical position and in phantom or dotted lines in a lower, horizontal position.

Referring now more particularly to the drawings, in FIGS. 1-3 is illustrated a new and improved patient treatment table constructed in accordance with the features of the present invention and referred to generally by the reference numeral 10. The treatment table is an improved version of the patient treatment table disclosed in U.S. Pat. No. 4,401,110, which patent is assigned to the same assignee as the present application, and which patent is incorporated herein by reference.

The patient treatment table 10 includes a lower base portion 12 adapted to rest on a floor surface 14 and an upper, patient supporting treatment table 16 which is mounted for pivotable movement relative to the lower base 12 between an upstanding position as shown in solid lines in FIG. 1 and a generally horizontal, lower position as shown in dotted lines therein.

The upper patient table 16 is mounted and supported on the base structure 12 for pivotal movement between a horizontal position and a near vertical, upwardly extending position. Movement between these positions is illustrated by the arcuate arrow "A" in FIG. 1. A suitable hydraulic-electric circuit used for controlling a single hydraulic cylinder which provides for pivoting the upper patient table 16 relative to the base 12 is shown in FIG. 11 of U.S. Pat. No. 4,401,110. The circuit includes a pair of electrically controlled solenoid valves for controlling the flow of hydraulic fluid to and from the hydraulic cylinder which in turn provides the force for moving the upper patient table to a desired level and/or tilt position.

In accordance with the present invention, a multistep control apparatus is provided for moving and controlling the position of the the upper patient table 16 as desired and the apparatus is referred to generally by the reference numeral 20. The control apparatus is detachably secured to the underside of the table base 12 at one end between feet 21 (FIG. 1) with cap screws 23 (FIG. 3) or with other suitable fastening means such as brackets installed with table feet. The screws 23 extend between a lower wall or flange 12*a* of the base and an upper flange 22*a* of a rectangular-shaped, elongated box or housing 22. The housing 22 is formed as a separate box and extends laterally between and beneath opposite sides 12*b* of the base portion 12 of the treatment table. The box includes a pair of opposite end walls 24 which are inset slightly from the opposite side walls 12*b* of the table base as shown in FIG. 3. The housing 22 also includes a pair of longitudinally extending transverse sidewalls 26 and a closed bottom wall 28. Preferably the housing 22 is formed of sheet metal of the appropriate gauge or thickness and the end walls and sidewalls thereof are relatively shallow in vertical dimension so that the housing as a whole will fit neatly beneath the bottom wall 12*a* and the surface of the floor 14 as shown in FIGS. 1, 2 and 3. Rubber feet 29 may be provided on the bottom wall 28 of the housing for additional support from the floor surface.

In accordance with the present invention, the control apparatus 20 includes an elongated operator element comprising a rod 30 which is mounted for reciprocal/longitudinal movement on the housing 22 as indicated by the arrow "B" in FIGS. 3 and 4 and for rotational movement as indicated by the arrow "C" in FIGS. 2, 4 and 5. The operator rod includes a pair of opposite outer end portions 32 which project outwardly of opposite end walls 24 of the housing 22 as best shown in FIG. 4. Annular bearings 34 are provided in the housing end walls 24 for supporting the rod 30 for longitudinal and rotational movement, and preferably the bearing elements are formed of suitable low friction material.

Preferably, the operator rod 30 is centered between the longer sidewalls 26 of the housing and is moveable in both directions perpendicular to the end walls 24 (as indicated by the arrow "B") from a longitudinal neutral position in response to longitudinal displacement pressure applied from either end portion 32. When such pressure or force is subsequently released, the rod is biased to return to the longitudinal neutral position by a pair of relatively stiff coil springs 36 mounted at opposite ends of the rod. The springs are outwardly engaged against the inside surface of the housing end walls 24 and are inwardly engaged against annular stops or collars 38 which are secured in position on the rod 30 by appropriate means such as set screws.

In accordance with the present invention, a contact member comprising a foot pedal 40 is mounted on each outer end portion 32 of the operator rod 30 so that a doctor's foot 42 can readily apply inward force as indicated by the arrow "B'" (FIG. 3) to initiate a first step or phase, in a control cycle of the apparatus 20. For this purpose, the foot pedal 40 is provided with an integral, upstanding kick plate 44 extending normal to the operator rod 30 and adapted to receive toe pressure from the doctor's foot.

In order to foreclose against inadvertent or accidental initiation of control action, the bias springs 36 are relatively strong so as to require a relatively large degree of inward toe pressure on either of the foot pedals 40 against a kick plate 44 to move the operator rod out of the longitudinally neutral position. Thus, a small child is not likely to be able to initiate a first phase or step that is necessary before further control action can proceed.

The rod element 30 is biased toward a rotationally neutral position (line D—D, FIG. 5) by means of a downwardly depending pin 46 and a pair of laterally outwardly extending coil springs 48 having outer ends secured to the bottom wall 28 of the housing 22 by appropriate fasteners such as bolts 49 (FIG. 4). The foot pedals 40 on the opposite end portions 32 of the operator rod 30 are provided with a pair of integral, laterally outwardly and downwardly sloping sole plates 50 (FIG. 2) adapted to receive downward pressure from the sole of a doctor's foot 42 applied eccentrically of the longitudinal axis of the operator rod 30 in order to rotate the rod in either direction away from a rotationally neutral position as represented by a vertical axis D—D as shown in FIG. 5.

The sole plates of each foot pedal are formed with ribs 52 on the upper surface thereof to provide for good frictional contact without slippage between the sole of a shoe and the control surface. As viewed from the left-hand end portion of FIG. 4, if the foot pressure applied by a doctor's shoe 42 is off center towards the sole plate 50 on the right of the operator rod 30, clockwise rotational displacement of the rod out of the neutral position occurs, whereas if foot pressure is applied downwardly against the opposite or lefthand sole plate 50, counterclockwise rotation away from the rotationally neutral position will occur. When foot pressure on either pedal is subsequently released, the bias springs 48 return the operator rod 30 to the rotationally neutral position.

As a first step in initiating a control cycle to tilt the patient support table 16 of the patient treatment table 10, a doctor applies foot pressure inwardly from either side of the table as shown in FIG. 4 (arrow "B") to displace the operator rod 30 longitudinally out of the longitudinally neutral position. An annular switch actuating sleeve 54 is secured in place on the rod intermediate its length by appropriate means such as a set screw and the sleeve includes a central groove 54*a* intermediate its opposite ends. This groove provides cam surfaces 56 of frusto-conical shape on opposite sides of a neutral center position in the middle of the sleeve. The cam surfaces are adapted to engage rollers on the end of switch levers 58*a* and 60*a* of a pair of micro-switches 58 and 60. Engagement occurs whenever the operator 30 is displaced out of the longitudinally centered, neutral position.

Referring to the schematic diagram of FIG. 7, a normally open switch 58 and a normally closed switch 60 are actuated to the opposite condition whenever the operator rod 30 is displaced longitudinally out of the neutral position in either direction.

Electrical power such as 110 volt AC, is supplied to the control apparatus 20 through main lines 62 and 64 and when the switch 58 is momentarily closed, a timer 66 receives an input signal and initiates a timing cycle. The power line conductor 62 is connected to a line 68 for the duration of this timing cycle by the timer 66. When foot pressure is released against the kickplate 44 of either foot pedal 40, the switch 58 returns to its normally open condition, but the line 68 remains connected to the power line conductor 62 until the end of the timing cycle. It has been found that a 12 second timing cycle is sufficient to enable a doctor to step on one of the foot pedal surfaces 52 and initiate a complete up or down cycle movement of the upper table 16 after he has moved the operator rod inwardly to initiate the timing cycle. If a doctor initiates an "up" or "down" cycle at any time within the 12 second timing period that the line 68 is energized, the cycle continues until completed, unless otherwise interrupted, even though the timing period has run out. It usually takes about 8 seconds for the table 16 to move through a complete "up" or "down" cycle between a lower, horizontal position of the support table (dotted lines) and a near vertical, upstanding position as shown in solid lines in FIG. 1.

The timer 66 is of a type generally available such as a solid state timer manufactured by SSAC, Inc. of Liverpool, NY, Model No. TSS422. For a 110 volt supply a load resistor of 6.8 ohms is connected across the output terminals of the timer to provide a load on the timer during portions of the timing cycle when other loads, such as a relay coil, are not present.

In accordance with the present invention, rotational movement of the rod element 30 in either direction as indicated by the arrow "C" out of a neutral rotational position (as indicated by the lines D—D in FIG. 5) is effective to actuate one or the other of a pair of microswitches 70 and 72 disposed on opposite sides of the elongated rod in the housing 22. The switches 70 and 72 include activating arms 70*a* and 72*a*, respectively, which extend along opposite sides of a downwardly depending, radial actuator pin 74 secured to the rod 30 to extend along the neutral rotational axis D—D when the rod is in a neutral rotational position. As viewed in FIG. 5, clockwise rotational movement of the operator 30 by means of right hand downward pressure on a sole plate 50 of one foot pedal 40 causes the microswitch 72 to be activated, whereas counterclockwise movement of the rod out of the neutral position causes activation of the microswitch 70. As pressure is released on either foot pedal, the bias springs 48 again center the rod with the actuator pin 74 extending downwardly along the neutral rotational axis D—D. The micro-switches 70 or 72 are then biased to return to the normally open condition.

In accordance with an important safety feature of the present invention, the foot pedal 40 on opposite sides of the side panels 12*b* of the base frame are provided with protective guards 80 formed of relatively strong metal. Each guard includes an outwardly projecting upper flange 80*a* designed to overlie the upstanding kickplate 44 of the adjacent foot pedal as shown in FIGS. 2 and 3. A lower flange portion 80*b* of each guard is secured to an adjacent end wall 24 of the housing 22 by appropriate fastening means such as cap screws 81. The pedal guards 80 act to minimize the chances of an inadvertent step by a doctor or other person near the table which might accidentally cause the upper table portion 16 to move up or down.

Referring now again more particularly to the circuit diagram of FIG. 7, the normally open switch 70 is connected in series with a table lowering control relay 82 connected to a line 84 which is in series with the switch 60 and a hand operated safety switch 86 connected to the supply line 64. The hand operated safety switch 86 is mounted at the head end of the upper table frame 16 to be conveniently actuated by the hand of a doctor in an emergency or at any time to stop all movement of the upper table. Opening of the safety stop switch 86 disconnects the power normally running from the supply line 64 to the line 84 which energizes the table lowering relay 82.

Additional safety is provided by the switch 60 which can be activated at any time to open the contacts thereof by inward movement of the operator rod 30 by foot pressure on the kick plates 44 of either foot pedal. Thus, the patient treatment table 10 has both a foot operated and a hand operated safety stop system for immediately stopping upward movement of the table 16 or downward movement of the upper table frame in order to prevent accidental pinching of a patient or child's arm or fingers between the frame and the upper edge portion of a sidewall 12*b* in an area generally designated as 88 in FIG. 1.

The auxiliary supply line 84 is connected to a table raising control relay 90 in series with an up limit switch 92 and the micro switch 72 which is activated by foot pedals for raising the upper table 16. When the upper table frame 16 reaches an upper, near vertical, tilted position, as shown in FIG. 1, the limit switch 92 is opened to deenergize the relay 90 and thereby prevent further upward tilting movement of the table.

In order to provide increased convenience in operating the table 10, a hand actuated, normally open table lowering switch 94 is mounted adjacent the head end of the upper table frame 16 so that the doctor may at any time lower the table under hand control and this is in addition to foot control available by means of the pedals 40 and the normally open switch 70 controlled thereby. The switch 94 is connected between the AC line 62 and one side of the table lowering relay 82 in parallel with the foot operated switch 70 so that the relay will be energized any time power is supplied to the lines 62 and 64 and the switches 60 and 86 are in the closed condition as shown in FIG. 7. No timer actuation is required for operation of the hand switch 94.

Similarly, a normally open table raising switch 96 is mounted adjacent the head end of the upper table frame 16 for hand operation by a doctor at any time to energize the table raising control relay 90 by hand control action in addition to the foot controlled action provided by the switch 72 of the foot control apparatus 20. The switch 96 is connected between the supply line 62 and one side of the limit switch 92 in series with the raising control relay 90 so that any time the switch 96 is closed and the switches 92, 60 and 86 are also closed, the relay 90 will become energized. No timer actuation is required for the hand switch 96.

The table lowering relay coil 82 includes the normally open holding contacts 82*a* and 82*b* and a third set of normally closed contacts 82*c*, and the table raising relay coil 90 includes the normally open holding contacts 90*a* and 90*b* and a set of normally closed contacts 90*c* as shown in FIG. 7. The relay 82 controls a hydraulic solenoid valve adapted to direct fluid flow from into one side of a hydraulic cylinder and permit the table 16 to move downwardly in pivotal movement from a near vertical, upstanding position (as in FIG. 1) to a horizontal position.

Whenever the table lowering relay 82 is energized, the normally open contacts 82*a* and 82*b* are closed and this permits the relay coil to remain energized even though the timing period has been completed and neither of the switches 94 or 70 is in a closed position. The contacts 82*b* when closed by the energized coil 82 complete a circuit from the line 62 through the contacts 90*c* to a lower level limit switch 98 which is connected to a solenoid valve relay 100. When this relay is energized, a solenoid valve is open to permit the weight of the table 16 alone or with a patient thereon to cause the table to move downwardly from an upper position by release of fluid from one side of the lift cylinder. After the table pivots back downwardly and reaches a horizontal position the lower limit switch 98 is opened and deenergizes the solenoid valve 100.

A pump motor 102 is provided for driving a hydraulic pump to supply fluid under pressure in order to raise the table 16. The pump motor is innerconnected between the power lines 62 and 64 in series with the contacts 82*c* and 90*b* so that whenever the solenoid raising relay 90 is energized, the contacts 90*b* are closed so as to complete the circuit to energize the motor 102 so that hydraulic fluid pressure is available in the system for raising the patient table. Once the raising relay 90 is energized, the pump motor 102 remains energized and running, and the relay 90 remains energized until the upper limit switch 92 is opened. This occurs because the contacts 90*a* and 90*b* are closed to provide a holding circuit between the line 62 and line 84 which is connected to the line 64 through the normally closed switches 60 or 86.

If the doctor desires to stop the table at an intermediate position, or, in the event of an emergency, either of the switches 60 or 86 may be opened so that the table raising relay 90 is deenergized and table movement stops immediately. Closing of the contacts 90*a* and 90*b* permits the table to continue raising even though the timing period set by the timer 66 has run out as long as the hand operated control switch 96 is closed unless the stop safety switches 60 or 86 are opened by manual or foot actuation thereof. When the raising relay 90 is energized pressurized fluid is directed into the "up" side of the cylinder for raising the table 16 toward a near vertical, upstanding position.

Although the present invention has been described with reference to a single illustrated embodiment thereof, it should be understood that numerous other modifications and embodiments can be made by those skilled in the art that will fall within the spirit and scope of the principles of this invention.

What is claimed as new and is desired to be secured by Letters Patent is:

1. In a patient treatment table having a base structure and an elongated patient table pivotally mounted thereon for movement between an up position and a down position, multi-step control apparatus for enabling a human operator standing adjacent said table to control the raising and lowering of said table in response to predetermined successive motions of said operator's foot, said apparatus comprising:

an operating element including a foot pedal positioned to be actuated by the foot of said operator, said table having a longitudinal axis and said element being movable along an axis generally transverse to said longitudinal axis of said patient table and also rotatable about said transverse axis;

means responsive to movement of said operating element along said transverse axis for initiating a timing cycle of predetermined duration;

means responsive to rotation of said operating element about said transverse axis during said timing cycle for raising and lowering said patient treatment table;

said operating element including a rod mounted for movement along said transverse axis and rotatable thereabout, first switch means positioned to be actuated in response to movement of said rod along said transverse axis, means responsive to actuation of said first switch means for initiating said timing cycle;

said means for raising and lowering said table including second switch means actuated in response to said rotation of said rod about said transverse axis;

said foot operated pedal being mounted on the end of said rod and bias means urging said rod toward a central position and opposing said movement of said rod along said transverse axis;

said foot pedal including a first control surface generally normal to said rod and adapted for movement by the toe of the operator to displace said rod longitudinally from said central position against said first bias means; and at least one second control surface generally normal to said first control surface and extending laterally with respect to said axis for engagement by the sole of the foot to rotate said rod about said transverse axis.

2. The control apparatus of claim 1 wherein said foot pedal includes a plurality of said second control surfaces extending in opposite directions with respect to said transverse axis for rotating said rod in opposite directions from a neutral rotational position.

3. The control apparatus of claim 2 wherein said first control surface projects upwardly of said rod and said plurality of second control surface slope downwardly and laterally outwardly in opposite directions with respect to said transverse axis.

4. The control apparatus of claim 2 including second bias means urging said rod toward said neutral rotational position against rotational forces applied by said foot pedal in either direction away from said neutral rotational position.

5. The control apparatus of claim 1 including a housing having means for supporting said rod for longitudinal and rotational movement, said housing having a pair of opposite walls and said rod having opposite end portions extending outwardly of said walls with a pair of said foot pedals mounted thereon.

6. The control apparatus of claim 5 including first bias means for urging said rod into a neutral longitudinal position against longitudinal displacement forces applied from said foot pedal on either of said opposite end portions tending to move said rod out of said neutral longitudinal position to initiate said timing cycle.

7. The control apparatus of claim 6 including second bias means for urging said rod toward a neutral rotational position against rotational displacement in opposite directions therefrom by rotational forces applied from either of said foot pedals tending to rotate said rod out of said neutral rotational position to initiate a raising or lowering cycle.

8. The control apparatus of claim 1 which includes first switch operating cam means on said rod engageable to activate said first switch means upon longitudinal displacement of said rod out of said neutral longitudinal position.

9. The control apparatus of claim 5 which includes first switch operating cam means on said rod engageable to activate said first switch means whenever said rod is displaced out of said neutral longitudinal position toward either of said opposite end portion thereof.

10. The control apparatus of claim 6 wherein said operator includes second switch operating cam means on said rod engageable to operate said second switch means whenever said rod is rotationally displaced out of said neutral rotational position.

11. The control apparatus of claim 10 wherein said second switch means includes a pair of switches, said second switch operating cam means including a cam surface engageable to activate one of said pair of switches upon rotational movement of said rod in one direction away from said neutral rotational position and engageable to activate the other of said pair of switches upon rotational movement of said rod in an opposite direction away from said neutral rotational position.

12. The apparatus of claim 5 wherein said housing is secured to said base structure with said opposite end portions of said rod projecting outwardly therefrom and wherein said foot pedals on said opposite end portions are accessible from opposite sides of said table.

13. The apparatus of claim 12 including, protective guard means positioned above each of said pedals for preventing inadvertent actuation thereof.

* * * * *